US005435402A

United States Patent [19]

Ziegenfuss

[11] Patent Number: 5,435,402

[45] Date of Patent: Jul. 25, 1995

[54] SELF-PROPELLED EARTH DRILLING HAMMER-BIT ASSEMBLY

[76] Inventor: Mark Ziegenfuss, 4 Edna Horn Dr., Stockton, N.J. 08559

[21] Appl. No.: 314,590

[22] Filed: Sep. 28, 1994

[51] Int. Cl.[6] ..... E21B 10/36

[52] U.S. Cl. ..... 175/414

[58] Field of Search ..... 175/414–418, 175/293–296, 298, 305, 106, 107

[56] References Cited

U.S. PATENT DOCUMENTS 2,371,248 4/1943 McNamara .
2,641,445 6/1953 Snyder .
4,408,670 10/1983 Schoeffler .
4,632,191 12/1986 McDonald et al. .
4,694,913 9/1987 McDonald et al. .
4,754,819 7/1988 Dellinger .
4,790,394 12/1988 Dickinson, III et al. .
4,834,193 5/1989 Leitko, Jr. et al. .
4,862,974 9/1989 Warren et al. .
4,890,682 1/1990 Worrall et al. .
4,948,925 8/1990 Winters et al. .
4,991,667 2/1991 Wilkes, Jr. et al. .
5,065,827 11/1991 Meyers et al. ..... 175/414
5,139,094 8/1992 Prevedel et al. .

*Primary Examiner*—Michael Powell Buiz
*Attorney, Agent, or Firm*—Kenneth P. Glynn

[57] ABSTRACT

The present invention is a self-propelled hammer-bit assembly for pneumatically drilling a borehole in the earth. It includes a hammer-bit member having an elongated main body with a hollow area therein and at least one blade located in the hollow area. The blade(s) is adapted to receive pressurized air to impart a rotation to the hammer-bit member which has a bit located at its distal end. The bit has at least one orifice to permit exit of pressurized air from the hollow area. For lateral stabilization with free rotation of the hammer-bit member, a bearing collar is connected to its elongated main body. There is also a distal barrel with the bearing collar connected thereto and the hammer-bit member located in the barrel collar. Finally, a reciprocation mechanism is located within the barrel and connected to the hammer-bit member to impart vertical reciprocation of the hammer-bit member in response to pressurized air. The invention also includes the hammer-bit member itself.

20 Claims, 3 Drawing Sheets

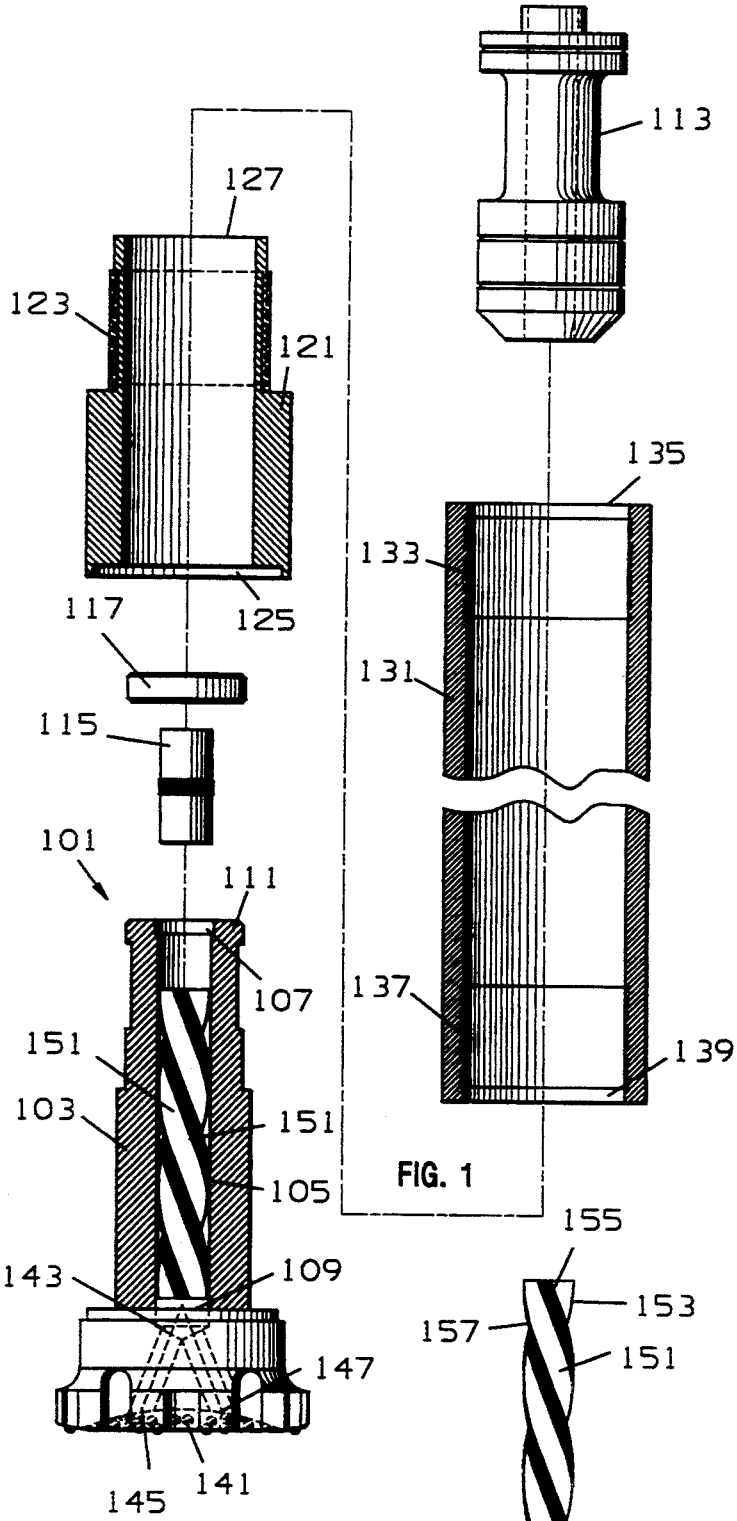
FIG. 1
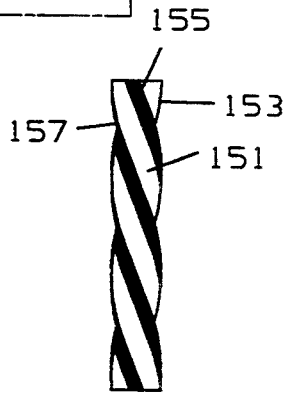
FIG. 2
FIG. 3
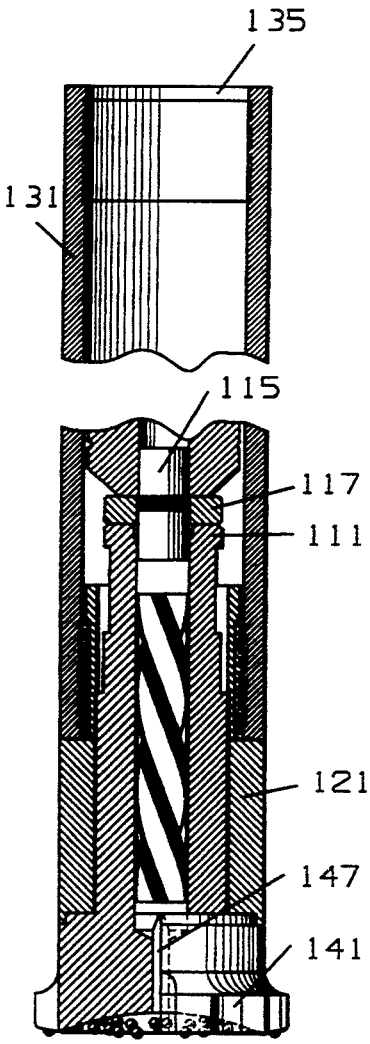
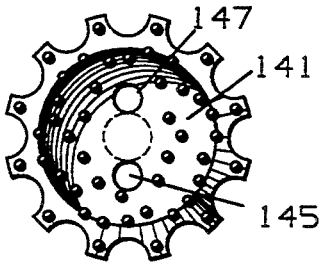
FIG. 4

SELF-PROPELLED EARTH DRILLING HAMMER-BIT ASSEMBLY

BACKGROUND OF THE INVENTION

1. Field of the Invention

The present invention involves a hammer-bit assembly for pneumatically drilling a borehole in the earth and more particularly, such assemblies which have eliminated the need for a mud motor or other motor to drive the hammer-bit.

2. Information Disclosure Statement

Numerous systems have been developed for boring the earth and there is significant patent literature on the subject. The following patent references illustrate the state-of-the-art and show numerous types of drilling systems which involve complex assemblies:

U.S. Pat. No. 5,139,094 to Bernhard Prevedel et al. involves methods which are provided for controlling the direction of a borehole drilled by a downhole motor, including the steps of positioning downhole adjustable bent housing and near-bit stabilizer in the drill string, adjusting the bent housing from its normally straight condition to its bent condition to effect borehole curvature, and using the stabilizer in its undergauge condition to enhance the inclination. The Measurements are made from which the inclination with respect to the vertical and the azimuth can be determined and telemetered uphole for processing, display and recording. Preferably the directional measurements are made at two locations, one below the bent point and one above it. These two sets of measurements can be compared to confirm the bend angle and to obtain a definition of the orientation of the plane of the bend angle so that the drilling path can be accurately controlled. The use of this invention eliminates having to superimpose rotation of the deflected drill string in order to drill straight ahead because the bend angle can be eliminated by downhole adjustment.

U.S. Pat. No. 4,991,667 to Robert D. Wilkes, Jr. et al. describes a hydraulic drilling method and apparatus in which the drilling fluid itself is utilized to control the direction in which a hole is bored in the earth. The drilling fluid is discharged through a plurality of forwardly facing nozzles which are inclined at different angles about the axis of the drill head, and the drilling fluid is selectively applied to the nozzles by a rotatable valve member to control the direction in which the hole is cut.

U.S. Pat. No. 4,948,925 to Warren Winters et al. involves an apparatus and method for orienting a collar on a fluid conducting conduit, such as a drill string, includes an orifice through the wall of the conduit and a latch assembly for latching the collar to the conduit. The latch assembly allows fluid communication through the orifice and rotates the collar when the conduit is rotated in a first direction about the longitudinal axis of the conduit. The latch assembly unlatches the collar from the conduit, prevents fluid communication through the orifice, and allows the conduit to rotate relative to the collar when the conduit is rotated in a second, opposite direction. Also included are apparatus and method for rotationally orienting a fluid conducting conduit including an insert connectable inside the conduit so that the insert is rotatable with the conduit; a flow passageway extending through the insert; a piston bore in the insert; a piston, reciprocally mounted in the piston bore, for reciprocating between the ends of the piston bore, the piston restricting flow through the flow passageway and creating a fluid pressure increase on the upstream side of the insert when the piston is in a restricted position in the piston bore; and a barrier mass for blocking the pilot passageway in a selected rotational position of the pilot passageway and conduit in order to increase the fluid pressure at the downstream end of the piston bore and move the piston to the restricted position in the piston bore.

U.S. Pat. No. 4,890,682 to Robert N. Worrall et al. involves a jarring apparatus which is used for vibrating a pipe string in a borehole. The apparatus thereto generates at a downhole location longitudinal vibrations in the pipe string in response to flow of fluid through the interior of said string.

U.S. Pat. No. 4,862,974 to Tommy M. Warren et al. describes a downhole drilling apparatus for use with an undergauge drill bit and comprises a downhole drilling motor which includes a housing and means for rotating the drill bit relative to the housing about an axis of rotation. The apparatus also comprises stabilizers connected to the housing for stabilizing the drill bit, and it further comprises cutters connected to the housing for cutting a borehole wall created by passage of the drill bit wherein the cutters extend radially outwardly relative to the axis of rotation to a greater extent than does the drill bit. A drilling assembly including such a drilling apparatus and a method of drilling a substantially vertical borehole in an earthen formation utilizing such an apparatus are also disclosed in the invention.

U.S. Pat. No. 4,834,193 to Curtis E. Leitko, Jr. et al. describes an earth boring apparatus which has a pneumatically operated earth boring tool, a flexible conduit or drill pipe connected to the tool and to a source of pneumatic fluid. The tool has an earth boring member and a reciprocally movable hammer positioned in the tool to apply a percussive force. A valve assembly in the flexible conduit or drill pipe substantially adjacent to the tool between the tool and the source of pneumatic fluid to the tool. The valve assembly has a pneumatic pressure-operated valve which is operable in response to the pressure of pneumatic fluid in the flexible conduit or drill pipe to be opened to permit flow of pneumatic fluid to the tool at a predetermined operating pressure to transmit an initial pulse of pneumatic fluid to initiate operation of the hammer. The valve is kept open at a lower pressure than that required to open it. One form of the valve is a pressure operated valve, spring-loaded toward closed position, which opens at a first predetermined pneumatic pressure permitting flow to said tool and closes at a second, substantially lower, pneumatic pressure. Another form of the valve means has a valve, spring-loaded toward closed position, which opens in response to pneumatic conduit pressure, and spring loaded ball detents or a pneumatic pressure operated latch to secure the valve in an open position. The latch and valve are operated to closed position at a lower pressure.

U.S. Pat. No. 4,790,394 to Ben W. O. Dickinson, III et al. involves a hydraulic drilling apparatus and method suitable for use in a variety of applications including the drilling of deep holes for oil and gas wells and the drilling of vertical, horizontal or slanted holes, drilling through both consolidated and unconsolidated formations, and cutting and removing core samples. The drill head produces a whirling mass of pressurized cutting fluid, and this whirling fluid is applied to a discharge nozzle to produce a high velocity cutting jet. The cutting action is enhanced by abrasive material in the drilling fluid. The direction of the borehole is controlled by controlling the discharge of the drilling fluid either in side jets directed radially from the distal end portion of the drill string which carries the drill head or in a plurality of forwardly directed cutting jets.

U.S. Pat. No. 4,754,819 to Thomas B. Dellinger describes a wellbore drill string which is formed from a plurality of sections of drill pipe interconnected at tool joints with a drill bit at its lower end. A drilling fluid is circulated down the drill string and up the annulus between the wellbore and the drill string. A plurality of annulus reducers located at spaced-apart positions along the drill string impart a cyclical pumping action to the flowing drilling fluid. During drilling, the drill string is axially reciprocated and an extension capability to the drill string maintains continuous weight on the drill bit.

U.S. Pat. No. 4,694,913 to William J. McDonald et al. is directed to a guided earth boring tool. Long utility holes, for gas lines, electrical conduit, communications conduit and the like, may be bored or pierced horizontally through the earth, particularly under obstacles, such as buildings, streets, highways, rivers, lakes, etc. Such holes may be bored by an underground drilling mole (underground percussion drill) supported on a hollow drill rod and supplied with compressed air through the rod to operate an air hammer which strikes an anvil having an external boring face, preferably constructed to apply an asymmetric boring force. The drill rod is operated by a drill rig on the surface or recessed in special pit for horizontal drilling and provides for addition of sections of pipe or hollow rod as the boring progresses. The asymmetric boring force causes the boring path to curve and, when straight line drilling is needed, the drill rod is rotated to counteract the asymmetric boring force. An alternative boring tool utilizes an expander supported on a solid or hollow drill rod and having a base end supported on and larger in diameter than the rod and tapering longitudinally forward therefrom. It may have a uniform extension protruding a short distance forward. The tool penetrates the earth upon longitudinal movement of the drill rod.

U.S. Pat. No. 4,632,191 to William J. McDonald et al. involves a steering system for percussion boring tools for boring in the earth at an angle or in a generally horizontal direction. The steering mechanism comprises a slanted-face nose member attached to the anvil of the tool to produce a turning force on the tool and movable tail fins incorporated into the trailing end of the tool which are adapted to be selectively positioned relative to the body of the tool to negate the turning force. The fins are constructed to assume a neutral position relative to the housing of the tool when the tool is allowed to turn and to assume a spin inducing position relative to the housing of the tool to cause it to rotate when the tool is to move in a straight direction. Turning force may also be imparted to the tool by an eccentric hammer which delivers an off-axis impact to the tool anvil. For straight boring, the tail fins are fixed to induce spin of the tool about its longitudinal axis to compensate for the turning effect of the slanted nose member or eccentric hammer. When the fins are in the neutral position, the slanted nose member or the eccentric hammer will deflect the tool in a given direction. The fins also allow the nose piece to be oriented in any given plane for subsequent steering operation.

U.S. Pat. No. 4,408,670 to William N. Schoeffler involves a sub assembly to be inserted between a drill string and a bit has a stabilizer sleeve to engage the walls of a bore hole and hold a first cam against rotation. A second cam is fixed to a drill holder at the lower end of the assembly and is driven in rotation by a rotary driving member extended through the assembly. The cams interengage so that relative rotation between them applies periodic impacts to the drill holder.

U.S. Pat. No. 2,641,445 to Robert E. Snyder describes a rotary impact drill intended for connection to a rotatable drill stem. It includes a rotary member adapted to be connected to the drill stem for movement therewith, a bit receiving member, a fluid coupling connected between the rotary member and the bit receiving member to rotate the latter at a speed less than that of the rotary member, whereby relative rotation between the members is produced. Also included are a hammer, which is reciprocally mounted on one of the members to deliver impacts to the bit receiving member, and cam means operatively connected between the relatively rotating members and to the hammer to reciprocate the latter when relative rotation exists between the drill stem and the bit receiving member.

U.S. Pat. No. 2,371,248 to John J. McNamara describes a well drill having a supporting body with a passageway extending downwardly from the top thereof, whereby a fluid under pressure may be supplied to the drill, a water turbine supported by the body, a by-pass conduit having its inlet end in the passageway and adapted to direct a portion of the supplied fluid past the turbine, other conduit means connected to the passageway to direct the remainder of the fluid to the turbine whereby to effect rotation thereof and a discharge conduit means extending down from the turbine for the spent fluid from the turbine. The by-pass conduit includes a nozzle which directs the by-passed fluid downwardly at an increased velocity into the discharge conduit for the spent fluid. Also included are a cutting tool, carried by said supporting body, means connected to the turbine to actuate the cutting tool, and means to direct the combined spent fluid and by-passed fluid to the vicinity of the cutting tool for washing away the cuttings, the last named means including means to prevent flow of fluid and cuttings into the apparatus from the cutting tool end.

Notwithstanding the above cited prior art, no reference teaches or suggests the present invention hammer-bit assembly which is self-propelled and which relies upon pressurized air to rotate the hammer-bit assembly.

SUMMARY OF THE INVENTION

The present invention is a self-propelled hammer-bit assembly for pneumatically drilling a borehole in the earth. It includes a hammer-bit member having an elongated main body with a hollow area therein and at least one blade located in the hollow area. The blade(s) is adapted to receive pressurized air to impart a rotation to the hammer-bit member which has a bit located at its distal end. The bit has at least one orifice to permit exit of pressurized air from the hollow area. For lateral stabilization with free rotation of the hammer-bit member, a bearing collar is connected to its elongated main body. There is also a distal barrel with the bearing collar connected thereto and the hammer-bit member located in the barrel collar. Finally, a reciprocation mechanism is located within the barrel and connected to the hammer-bit member to impart vertical reciprocation of the hammer-bit member in response to pressurized air. The invention also includes the hammer-bit member itself.

BRIEF DESCRIPTION OF THE DRAWINGS

FIG. 1 shows an exploded side view of a present invention self-propelled hammer-bit assembly;

FIG. 2 shows a side view of the blades located within the elongated main body of the present invention device shown in FIG. 1;

FIG. 3 shows an assembled front view of the device shown in FIG. 1 and FIG. 4 shows a bottom view thereof;

FIG. 12 shows an exploded front cut view of yet another present invention self-propelled hammer bit assembly; and, FIG. 13 shows a front cut view of the same device in its assembled form while

DETAILED DESCRIPTION OF THE PRESENT INVENTION

Figure 5:
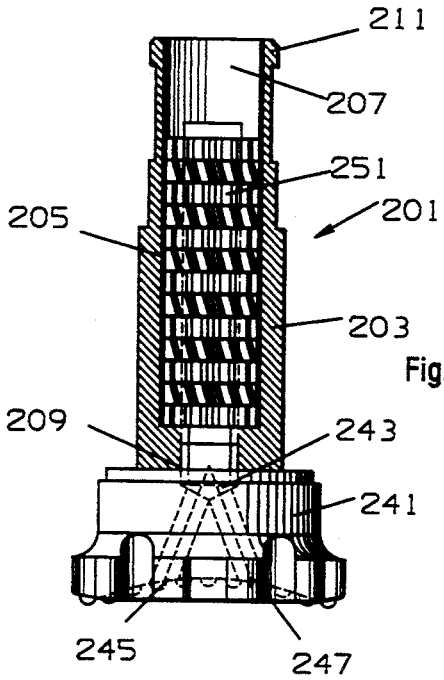
FIG. 5 shows a side view of an alternative embodiment present invention self-propelled hammer-bit assembly using turbine blades.

Referring to FIG. 1, there is shown an exploded side view of one embodiment of the present invention self-propelled hammer-bit assembly. Hammer-bit member 101 has an elongated main body 103 with a hollow area 105. At the top of the hollow area 105 is top 107 and at the opposite end is bottom 109. Additionally, there is an annular shoulder 111, a foot valve 115 and attachment ring 117. Hammer piston 113 is shown and this operates in accordance with conventional pneumatic hammer drill principles and with additional conventional pneumatic hammer components (not shown) known in the art.

Within hollow area 105 of elongated main body 103 is blade set 151 which is shown in more detail in FIG. 2. Blade set 151 is locked into the hollow area 105, either by being slid into grooves therein, by being welded thereto, or otherwise being firmly fixed therein. There is a bearing collar shown generally as collar 121 with outer threads 123, bottom 125 and 127. Additionally, a broken view of distal barrel 131 is shown having a top 135 and a bottom 139 with upper and lower internal threads 133 and 137 respectively. Threads 137 are adapted to meet with external threads 123 of bearing collar 121. Threads 133 at top 135 of distal barrel 131 is adapted to interlock with other sections of a standard drilling assembly such as a plurality of interconnected barrels.

FIG. 2 shows a side view of the blades located within the elongated main body 103 and it can be seen here that is, first blade 153, second blade 155 and third blade 157. As mentioned above, these are fixedly arranged within hollow area 105 of elongated main body 103.

FIG. 3 shows an assembled front view of the device shown in FIG. 1. All like parts are like numbered, and hammer piston 113 is partially shown. It can now be seen that positive air pressure driven down through distal barrel 131 which normally activates hammer piston 113 will cause a reciprocal vertical motion and, at the same time, the air pressure will then impact upon blade set 151 and will cause hammer-bit member 101 to rotate. Bit 145, which is an integrally formed aspect of hammer-bit member 101, has a top 143 which has an opening connected to orifice outlets 145 and 147. This is also shown in its bottom view in FIG. 4 and reference is now made to FIGS. 1, 3 and 4 together. The pressurized air which is pumped into the distal barrel 131 and activates the hammer piston 113, and rotates hammer-bit member 101 by impinging upon blade set 151, subsequently exits via orifice outlets 145 and 147.

Typically, conventional pneumatic hammer drills rely upon air pressure to drive the hammer and rely upon mud motors, mechanical drives or other means to rotate the drill. The compressors usually operate at 1000 to 2000 or more cfm pressure but this is choked down to only 450 to 750 cfm to drive the hammer piston. The balance of the available pressure is used on the present invention to drive the drill bit and may be choked at the compressor to regulate drill speed.

FIGS. 5 through 10 relate to an alternative embodiment of the present invention and, specifically, FIG. 5 shows a side view of this present invention alternative embodiment self-propelled hammer-bit assembly. Thus, hammer-bit member 201 is shown and has the general configuration of hammer-bit member 101 shown in the previous Figures and may similarly be connected to distal barrel 131 using a bearing collar such as bearing collar 121 shown in FIG. 1.

Referring specifically to FIG. 5, hammer-bit member 101 includes an elongated main body 203 with a hollow area 205 which, in this case, is occupied by blade set 251. There is a top 207 of elongated main body 203 and a bottom 209. Bit section 241 is similar to bit 141 in FIG. 1 as are orifice outlets 245 and 247. Annular shoulder 211 functions in the same manner as shoulder 111 shown in FIG. 1, i.e., receives the reciprocating blows of a hammer piston.

Figure 6:
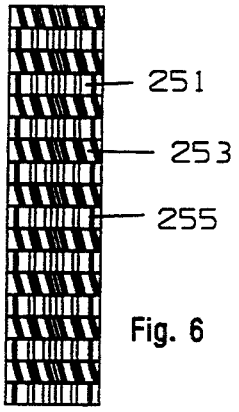
FIG. 6 shows a side view of the turbine blade of the device shown in FIG. 5.
Figure 7:
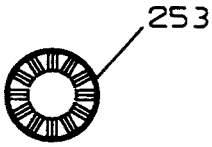
FIGS. 7, 8, 9 and 10 show top, side, top and side views respectively of turbine blade components used in the device shown in FIG. 5.
Figure 8:
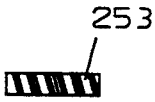
Figure 9:
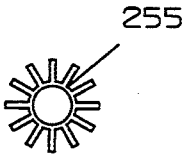
Figure 10:
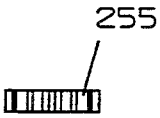

FIG. 6 shows a view of blade set 151 and, in this case, comprises a stack of alternating turbine blades which are essentially vertical and, alternatively, vertically biased but angularly pitched. Thus, referring to FIGS. 6 through 10, the sandwiched arrangement of the fixed turbines in blade set 251 includes angularly pitched turbine blade members 253 of which is typical and shown in its top and side view in FIGS. 7 and 8 respectively, as well as vertical blade members 255 shown in its top and side view in FIGS. 9 and 10 respectively. Blade set 251 is permanently connected to hammer-bit member 201 and, through positive air pressure down a distal barrel (not shown) the vertical reciprocation is achieved as well as circular rotation about a central axis in the vertical plane.

Figure 11:
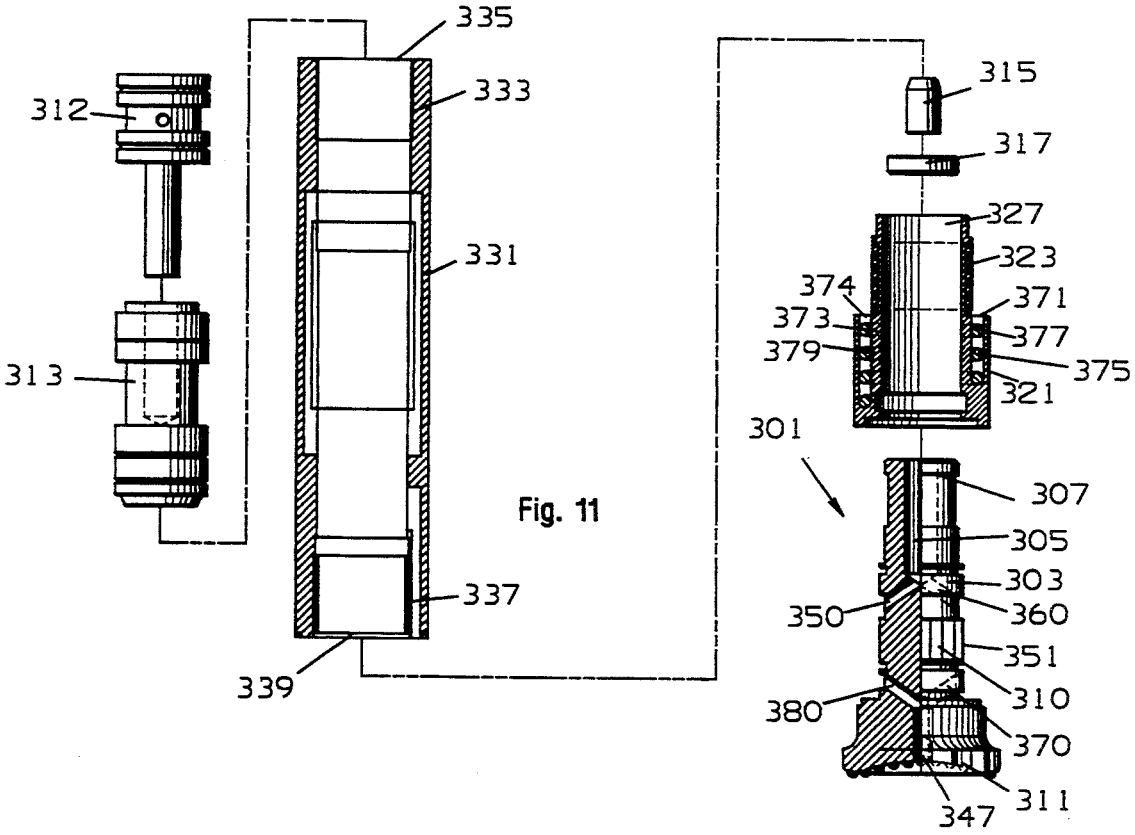
FIG. 11 shows a front exploded view of another alternative embodiment present invention device using vertical blades.

FIG. 11 shows yet another alternative embodiment, in this case, in an exploded front cut view. Hammer 312 and hammer piston 313 are shown and operate in the same fashion as conventional pneumatic hammer drill hammers and pistons. Distal barrel 331 is shown having a top 335 and a bottom 339 with upper and lower internal threads 333 and 337, respectively. Threads 337 are adapted to connect with external threads 323 of bearing collar 321. Threads 333 at top 335 are adapted to interconnect with other sections of a standard drilling assembly which typically uses a plurality of interconnected barrels. Here, hammer-bit member 301 includes an elongated main body 303 which has a top 307 and a bottom 311. Hollow area 305, in this case, is adapted to receive the components, including a foot valve 315. Hollow area 310 is located on the outside of elongated main body 303 (instead of the inside such as is the case of the embodiments described in conjunction with earlier drawings) and includes blade set 351, in this case, external angular blades fixedly mounted vertically about outside hollow area 310. Bearing collar 321 has threads 323 similar to threads 123 in FIG. 1. However, shoulder 371 includes a series of inlet orifices which include a series of vertical inlets such as inlet 374, as well as tapered somewhat horizontal inlets represented by inlets 373, 375, 377, 379, etc. Air enters through the top 307 into hollow area 305 and downwardly and outwardly through inlet tubes such as tubes 350 and 360. The air then enters the vertical inlets such as inlets 374 and then enters the inlets 373 through 379 mentioned, to cause air to impinge upon blade set 351 to cause rotation of hammer-bit member 301. Subsequently, the air will exit through downwardly tapered tubes such as tubes 370 and 380 and then will exit through orifice outlets such as orifice outlet 347.

Figure 12:
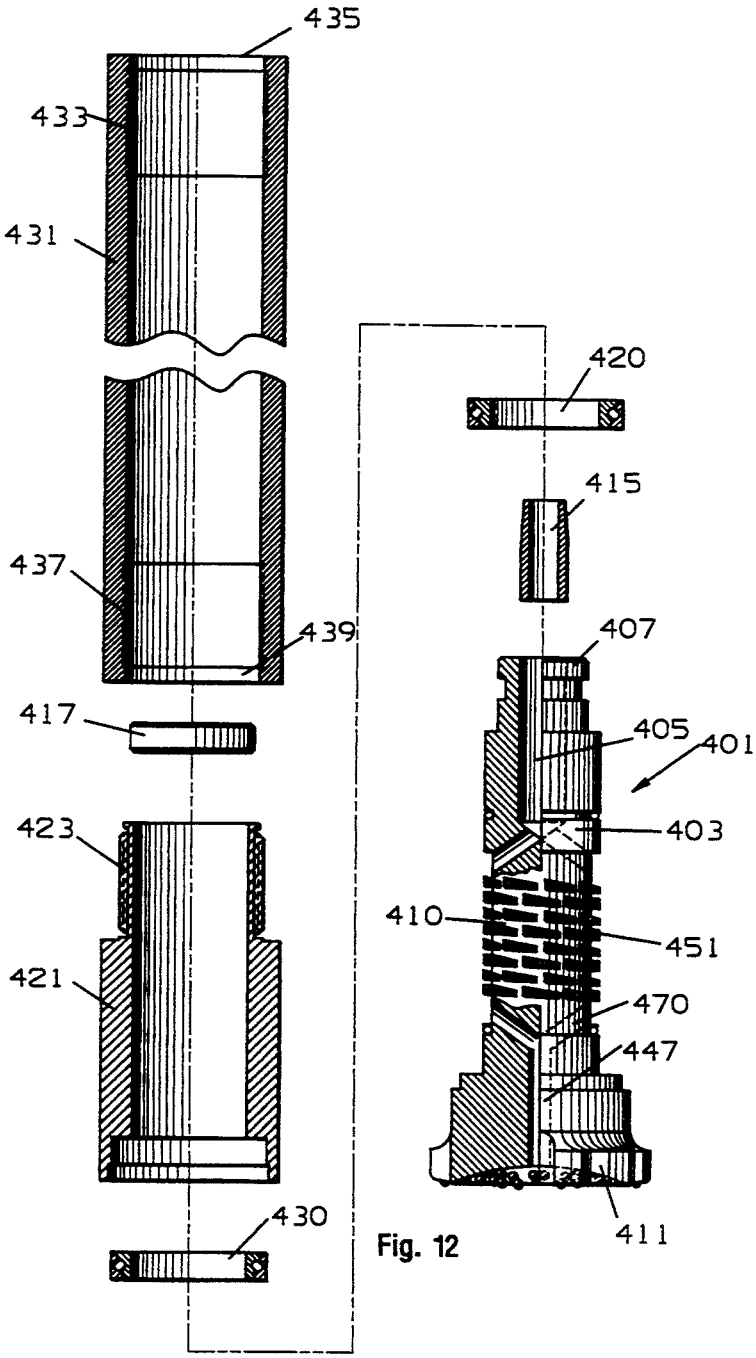
Figure 13:
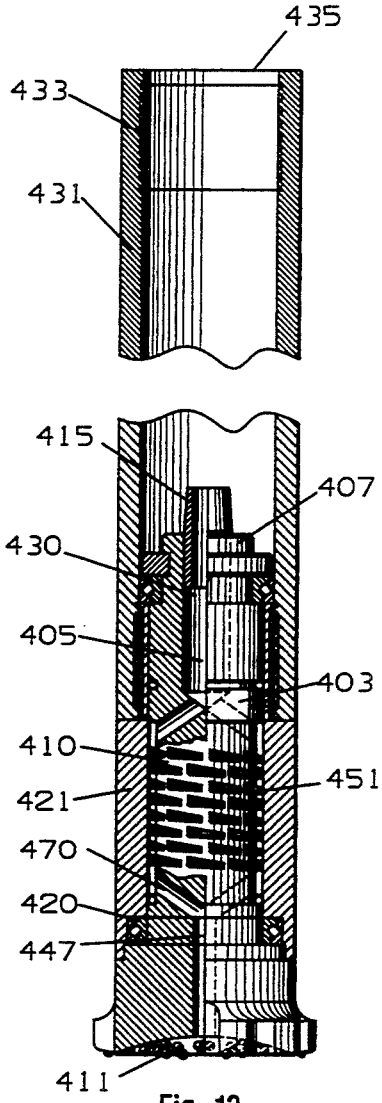
Figure 14:
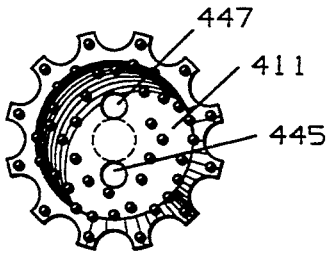
FIG. 14 shows a bottom view thereof.

FIG. 12 shows another alternative embodiment, in this case, in an exploded front cut view; FIG. 13 shows a partial cut, fully assembled view of the present invention device shown in FIG. 12 and FIG. 14 shows a bottom view thereof. Referring to FIGS. 12 and 13, distal barrel 431 is shown having a top 435 and a bottom 439 with upper and lower internal threads 433 and 437, respectively. Threads 437 are adapted to connect with external threads 423 of bearing collar 421. Threads 433 at top 435 are adapted to interconnect with other sections of a standard drilling assembly which typically uses a plurality of interconnected barrels. Here, hammer-bit member 401 includes an elongated main body 403 which has a top 407 and a bottom 411. Hollow area 405, in this case, is adapted to receive the components, including a foot valve 415. Hollow area 410 is located on the outside of elongated main body 403 (as is the case of the embodiment described immediately above) and includes blade set 451, in this case, spaced, arrowhead external blades fixedly mounted obliquely about outside hollow area 410, as shown. Bearing collar 421 has threads 423 similar to threads 123 in FIG. 1. Attachment rings 420 and 430 are also shown for securing the components as shown assembled in FIG. 13. Air enters through the top 407 into hollow area 405 and downwardly and outwardly through inlet tubes such as tubes 450 and 460. The air then enters the vertical inlets such as inlets 474 and then enters the inlets 473 through 479 mentioned, to cause air to impinge upon blade set 451 to cause rotation of hammer-bit member 401. Subsequently, the air will exit through downwardly tapered tubes such as tubes 470 and 480 and then will exit through orifice outlets such as orifice outlet 447. FIG. 14 shows a bottom view of bottom 411 with final outlet orifices 445 and 447.

It can now be seen that the present invention devices enable the boring of the earth using rotating, reciprocating bits, without the need for mud motors, drive motors and other expensive equipment heretofore used in the industry. Thus, the use of air pressure to both rotate and oscillate without a motor in a present invention not only eliminates the mud motor assembly but also eliminates the need to pump mud to and from a mud motor, an expensive and wearing operation. It has been found that normal mud motors cost as much as $165.00 per hour to operate based on initial costs and the wear factor. The present invention has a 60% to 75% increase in efficiency over the straight drill bits due to the elimination of the mud motors and the use of air rather than gritty clay mud solutions. Thus, the present invention offers a lighter, less expensive, less complex assembly to achieve the same results that have heretofore been achieved using mud motors and other complex systems.

Obviously, numerous modifications and variations of the present invention are possible in light of the above teachings. It is therefore understood that within the scope of the appended claims the invention may be practiced otherwise than as specifically described herein.

What is claimed is:

1. A self-propelled hammer-bit assembly for penumatically drilling a borehole in the earth, which comprises:

a.) a single structure hammer-bit member having an elongated main body, said main body including at least one hollow area therein and having at least one blade located in said hollow area which is adapted to receive pressurized air to impart a rotation to said hammer-bit member, said hammer-bit member having a proximal end and a distal end, and having a bit located at its distal end, said bit having at least one orifice located therein and extending from an open surface of said bit to said hollow area of said elongated main body to permit exit of pressurized air from said hollow area, said hammer-bit member further having means for connection thereof to a bearing collar for lateral stabilization with free rotation of said hammer-bit member;

b.) a bearing collar connected to said elongated main body of said hammer-bit member and having barrel-connecting means;

c.) a distal barrel having said bearing collar connected thereto with said hammer-bit member located in said barrel collar; and, d.) a reciprocation mechanism located within said barrel and connected to said hammer-bit member and adapted to impart vertical reciprocation of said hammer-bit member in response to pressurized air, and having an air opening to permit incoming pressurized air to said distal barrel to enter said hollow area of said main body of said hammer-bit member.

2. The combined hammer-bit assembly of claim 1 wherein said hollow area is located on an outside surface of said elongated main body forming a concentric open area between said elongated main body and said collar, and said at least one blade is a plurality of blades in the form of directed fins located vertically within said hollow area and attached to said elongated main body.

3. The combined hammer-bit assembly of claim 2 wherein said collar includes a plurality of orifices therethrough to receive pressurized air from said distal barrel and to impart said pressurized air upon surfaces of said fins to cause rotation of said hammer-bit member.

4. The combined hammer-bit assembly of claim 1 wherein said elongated main body has a hollow center and said at least one blade is fixedly located within said hollow center.

5. The combined hammer-bit assembly of claim 4 wherein at least one blade is at least one auger-type downwardly spiralling blade.

6. The combined hammer-bit assembly of claim 5 wherein there are a plurality of said auger-type blades which symmetrically spiral downwardly about an imaginary vertical control axis of said elongated main body.

7. The combined hammer-bit assembly of claim 4 wherein said at least one blade is at least one turbine blade having a concentric configuration within said hollow center.

8. The combined hammer-bit assembly of claim 7 wherein there are a plurality of said turbine blades.

9. The combined hammer-bit assembly of claim 1 wherein said bit has a single orifice therethrough.

10. The combined hammer-bit assembly of claim 9 wherein said single orifice is a centrally located vertical orifice.

11. The combined hammer-bit assembly of claim 1 wherein said bit has a plurality of orifices therein.

12. The combined hammer-bit assembly of claim 11 wherein said plurality of orifices are non-vertical and are symmetrically located about a central vertical axis.

13. A hammer-bit member, which comprises: a single structure hammer-bit member having an elongated main body, said main body including at least one hollow area therein and having at least one blade located in said hollow area which is adapted to receive pressurized air to impart a rotation to said hammer-bit member, said hammer-bit member having a proximal end and a distal end, and having a bit located at its distal end, said bit having at least one orifice located therein and extending from an open surface of said bit to said hollow area of said elongated main body to permit exit of pressurized air from said hollow area, said hammer-bit member further having means for connection thereof to a bearing collar for lateral stabilization with free rotation of said hammer-bit member.

14. The hammer-bit member of claim 13 wherein said hollow area is located on an outside surface of said elongated main body forming a concentric open area between said elongated main body and said collar, and said at least one blade is a plurality of blades in the form of directed fins located vertically within said hollow area and attached to said elongated main body.

15. The hammer-bit member of claim 13 wherein said elongated main body has a hollow center and said at least one blade is fixedly located within said hollow center.

16. The hammer-bit member of claim 15 wherein at least one blade is at least one auger-type downwardly spiralling blade.

17. The hammer-bit member of claim 16 wherein there are a plurality of said auger-type blades which symmetrically spiral downwardly about an imaginary vertical control axis of said elongated main body.

18. The hammer-bit member of claim 15 wherein said at least one blade is at least one turbine blade having a concentric configuration within said hollow center.

19. The hammer-bit member of claim 18 wherein there are a plurality of said turbine blades.

20. The hammer-bit member of claim 13 wherein said bit has a plurality of orifices therein.

* * * * *